US007152862B1

(12) United States Patent
Chiu

(10) Patent No.: US 7,152,862 B1
(45) Date of Patent: Dec. 26, 2006

(54) INTELLIGENT TOY BALL

(76) Inventor: I-Cheng Chiu, 9F, No. 70 Sec. 5. Nan-King East Rd., Taipei (TW)

( * ) Notice: Subject to any disclaimer, the term of this patent is extended or adjusted under 35 U.S.C. 154(b) by 0 days.

(21) Appl. No.: 11/348,621

(22) Filed: Feb. 6, 2006

(51) Int. Cl.
*A63F 7/00* (2006.01)

(52) U.S. Cl. ..... 273/109

(58) Field of Classification Search ..... 273/108, 273/109, 118 R, 153 R, 153 S, 441; 446/170; 482/45

See application file for complete search history.

(56) References Cited

U.S. PATENT DOCUMENTS 440,160 A * 11/1890 Hoyt ..... 273/109
3,758,981 A * 9/1973 Hlasnicek et al. ..... 446/170
4,042,244 A * 8/1977 Kakovitch ..... 273/109
4,537,401 A * 8/1985 Smith et al. ..... 273/112
4,632,391 A * 12/1986 Orak ..... 482/110
5,667,221 A * 9/1997 Lievre ..... 273/153 R
5,692,944 A * 12/1997 Pellicone ..... 446/170

* cited by examiner

*Primary Examiner*—Raleigh W. Chiu
(74) *Attorney, Agent, or Firm*—Pro-Techtor Int'l Services

(57) ABSTRACT

The present invention relates to an intelligent toy ball, comprising a transparent sphere, a ball bearing bracket enclosed inside the sphere, a colored ball bearing, and two retaining rings that are enveloped on the ball bearing bracket to position the sphere, wherein the ball bearing bracket is provided with a continuous, curved figure-8 track, such that the ball bearing can roll inside the track, and when a user holds the sphere with two hands, he/she can continuously change his/her hand position to facilitate the dual use of hands and brain for educational and entertainment purposes.

4 Claims, 3 Drawing Sheets

INTELLIGENT TOY BALL

BACKGROUND OF THE INVENTION (a) Field of the Invention

The present invention relates to a transparent circular ball having a ball bearing bracket therein, and the ball bearing bracket comprises a continuous, curved track such that a user can roll the ball bearing inside the track with his/her wrist along a trajectory just like Tai Chi diagrams.

(b) Description of the Prior Art

The majority of conventional intelligent toys are balls, ball plates, or modular balls. As no radical changes have been made on their structure, it is not possible to achieve the educational effects of hand-brain coordination.

SUMMARY OF THE INVENTION

To overcome the abovementioned drawback, the primary object of the present invention is to dispose a ball bearing bracket inside a transparent sphere, and the ball bearing bracket is provided with a curved figure-8 track just like Tai Chi diagrams, such that when a user grasps the sphere with two hands and continuously changes his/her hand positions, a ball bearing rapidly rolls inside the curved figure-8 track like Tai Chi diagrams. In this way, it forms an intelligent toy that activates body actions and enhances eye-hand coordination and hand-brain coordination.

To enable a further understanding of the objectives and the technological methods of the invention herein, the brief description of the drawings below is followed by the detailed description of the preferred embodiments.

BRIEF DESCIPTION OF THE DRAWINGS

DETAILED DESCRIPTION OF THE PREFERRED EMBODIMENTS

Figure 1:
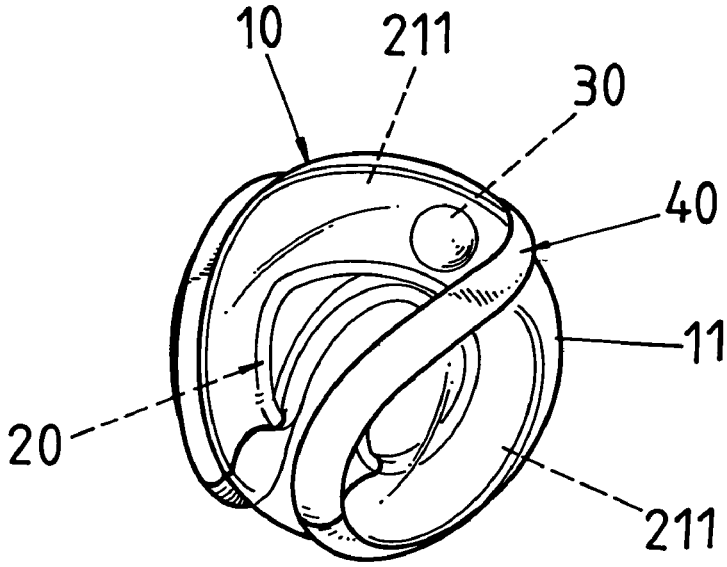
FIG. 1 shows an external view of the present invention.
Figure 2:
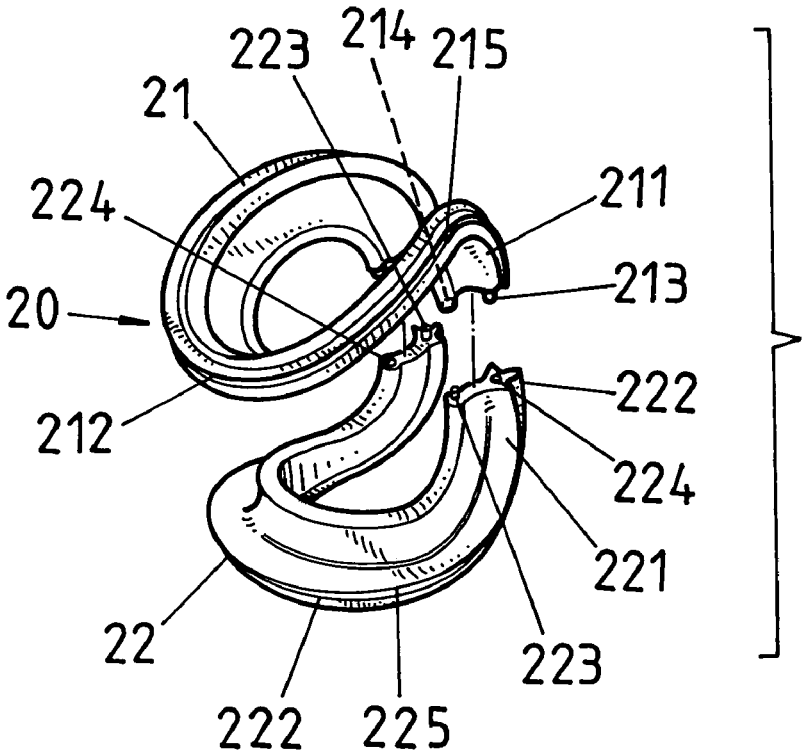
FIG. 2 shows a structural view of the ball bearing bracket according to the present invention.

Referring to FIG. 1, the present invention comprises a transparent sphere 10, a ball bearing bracket 20, a ball bearing 30, and two retaining rings 40. Referring to FIG. 2, the ball bearing bracket 20 is formed by two arc-shaped base bodies 21 and 22. The two base bodies 21 and 22 are identical in structure and are provided with an arc-shaped track 211 or 221 on an interior therein respectively and a curved slot 212 or 222 on an exterior thereon respectively. A male projection 213 or 223 and a female hole 214 or 224 are provided on each of the two respective ends of the respective base bodies 21 and 22. A projection ring 215 or 225 is disposed on a rim of the respective slot 212 or 222, wherein the male projection 213 on the top base body 21 is inserted into the female hole 224 on the bottom base body 22, and the male projection 223 on the bottom base body 22 is inserted into the female hole 214 on the top base body 21, such that the ball bearing bracket 20 is configured into a continuous, curved figure-8 track 211 and 221 respectively.

Figure 3:
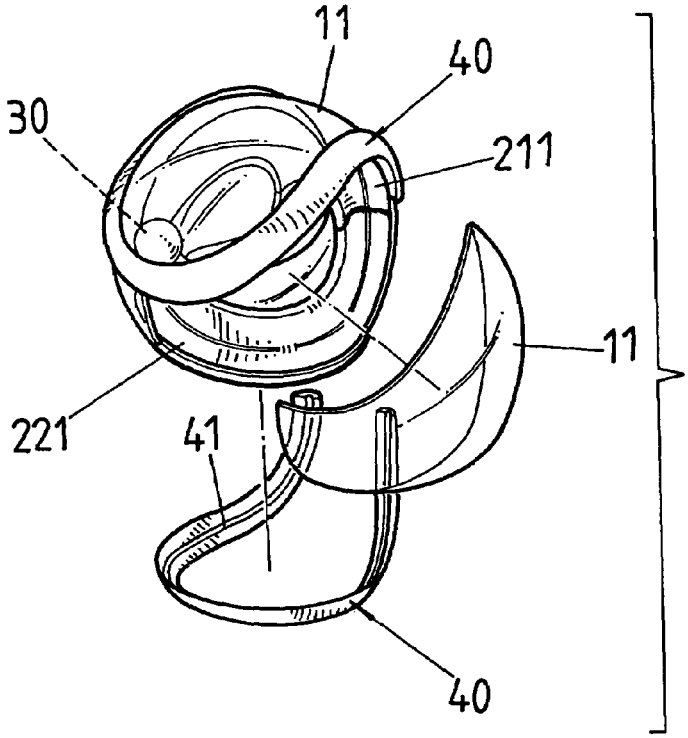
FIG. 3 shows an exploded perspective view of a part of the present invention.
Figure 4:
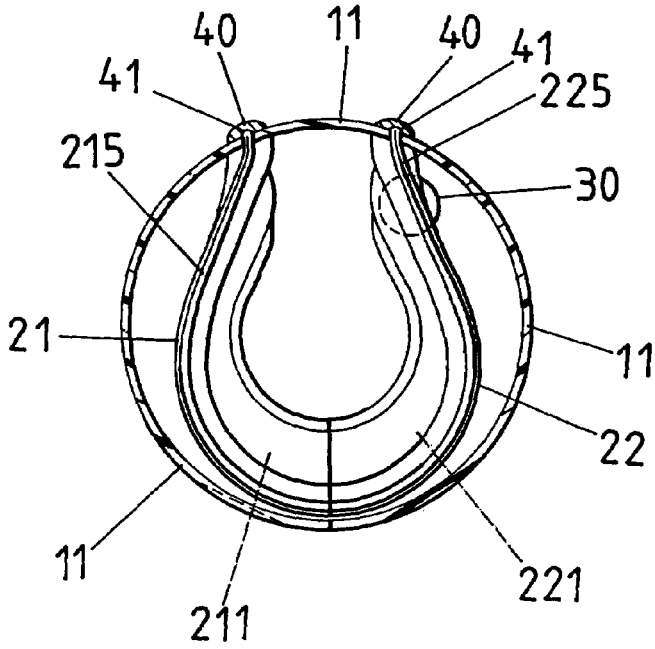
FIG. 4 shows a plan schematic view of the present invention.

Referring to FIG. 3, the transparent sphere 10 is formed by four same arc-shaped transparent ball shields 11. Each ball shield 11 is inserted into a slot 212 or 222 on the respective base body 21 or 22 and then positioned, whereas a curved groove 41 is disposed in an inner rim on each of the two curved retaining rings 40. The groove 41 can be inserted into the respective projection ring 215 or 225 on the respective base body 21 or 22. With the help of high frequency waves, each of the retaining rings 40 is fixed on the respective base body 21 and 22 such that the four ball shields 11 are inserted into one another and positioned (as shown in FIG. 4.) The retaining rings 40 are enclosed on an exterior of the sphere 10, thereby protecting the sphere 10 and making the sphere 10 elastic.

Figure 5:
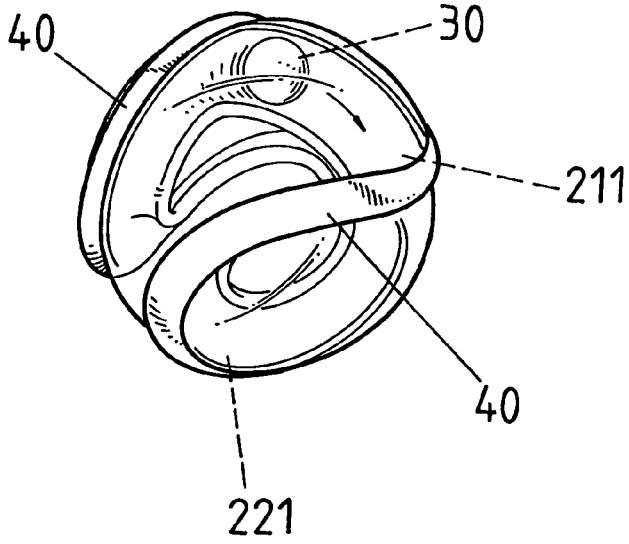
FIG. 5 is a first embodiment showing the working condition of the present invention.
Figure 6:
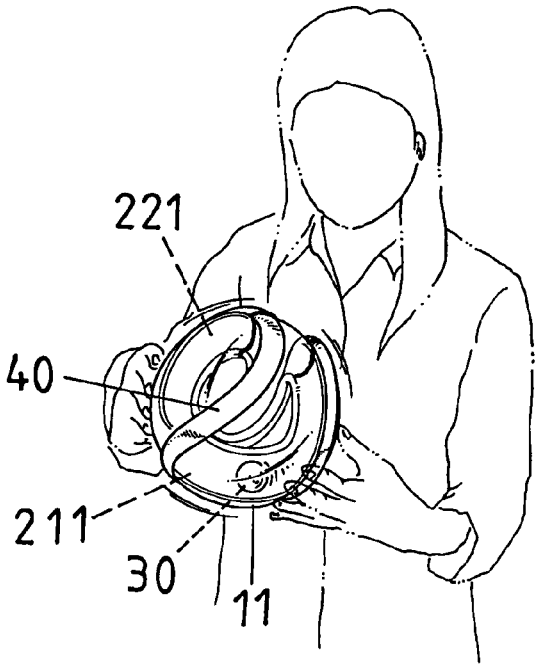
FIG. 6 is a second embodiment showing the working condition of the present invention.

The ball bearing 30 is enclosed inside the transparent sphere 10. The colored ball bearing 30 is located inside the respective track 211 and 221 of the ball bearing bracket 20. Referring to FIG. 5, when the ball bearing 30 is rolling instantaneously inside the track 211, the user can change the hand position of holding the ball (as shown in FIG. 6) such that the ball bearing 30 rapidly rolls to an interior of another track 221. By repeatedly adjusting the hand positions, the ball bearing 30 repeatedly moves inside the 211 and 221, thereby facilitating the dual use of one's hands and brain for educational and entertainment purposes.

In summary, the present invention is to enclose a ball bearing bracket 20 inside a transparent sphere 10, and the ball bearing bracket 20 is provided with a curved figure-8 track 211 and 221, such that when a user changes the hand position of grasping the sphere 10, the ball bearing 30 rapidly rolls inside the track 211 and 221, thereby forming an intelligent toy that facilitates the dual use of one's hands and brain.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. An intelligent toy ball comprising:

a sphere, formed by at least one transparent ball shield;

a ball bearing bracket, enclosed inside the sphere and formed by the insertion of two base bodies, each of which is provided with a track therein, such that the tracks are connected and configured into a looping curved figure-8 track;

a ball bearing, rolling inside the track of the ball bearing bracket;

two retaining rings, fixed on the two base bodies of the ball bearing bracket, such that the ball shields of the sphere are positioned;

such that when a user holds the intelligent toy ball with two hands, the ball bearing rolls inside the track.

2. The intelligent toy ball as claimed in claim 1, wherein a curved slot is disposed on each of the two base bodies of the ball bearing bracket for the insertion of the ball shields.

3. The intelligent toy ball as claimed in claim 1, wherein a male projection and a female hole are disposed on each of the two ends of the two respective base bodies of the ball bearing bracket, such that the male projection and the female hole of the two base bodies can be inserted into one another.

4. The intelligent toy ball as claimed in claim 1, wherein a projection ring is disposed on an inner rim of the two base bodies of the ball bearing bracket, and a groove is disposed on an inner rim of each of the retaining rings, such that the groove is inserted into the projection ring and then positioned.

* * * * *